United States Patent [19]

Masalin et al.

[11] Patent Number: 4,615,053

[45] Date of Patent: Oct. 7, 1986

[54] PIPE COUPLING WITH WATER SEAL BETWEEN THE SINKS OF A DRAIN BOARD AND THE DRAIN PIPE

[75] Inventors: Heikki Masalin, Espoo; Kalervo Männistö, Vantaa; Eero Saarinen, Lahti, all of Finland

[73] Assignee: Oy All-Plast Ab, Helsinki, Finland

[21] Appl. No.: 686,159

[22] Filed: Dec. 26, 1984

[30] Foreign Application Priority Data

Dec. 28, 1983 [FI] Finland ..... 834815

[51] Int. Cl.[4] ..... E03C 1/04; E03C 1/22

[52] U.S. Cl. ..... 4/191; 4/197

[58] Field of Search ..... 4/191, 192, 194–197, 4/207, 208, 211, 288

[56] References Cited

U.S. PATENT DOCUMENTS

| | | | |
|---|---|---|---|
| 190,766 | 5/1877 | Keyser | 4/197 |
| 1,185,960 | 6/1916 | Wessels | 4/208 |
| 3,314,082 | 4/1967 | Minella | 4/194 |
| 3,725,964 | 4/1973 | Whitsett | 4/197 |
| 4,158,897 | 6/1979 | Cocherel | 4/207 |
| 4,463,461 | 8/1984 | van der Broeke et al. | 4/288 |

FOREIGN PATENT DOCUMENTS

| | | | |
|---|---|---|---|
| 8374 | of 1928 | Australia | 4/197 |
| 57998 | 7/1980 | Finland . | |
| 945535 | 5/1949 | France . | |
| 1497878 | 10/1967 | France . | |
| 8200799 | 9/1983 | Netherlands | 4/191 |
| 207953 | 10/1966 | Sweden | 4/191 |
| 1595899 | 8/1981 | United Kingdom | 4/207 |

*Primary Examiner*—Stephen Marcus
*Assistant Examiner*—L. J. Peters
*Attorney, Agent, or Firm*—Owen, Wickersham & Erickson

[57] ABSTRACT

A pipe coupling with a water seal between the sinks of a draining board and the drain pipe (9), comprising a collecting pipe (4) having connected thereto one or a plurality of jointing pipes (3) for sink connecting tubes (2) and a water seal forming pipe element (7) as well as a jointing pipe (6) for said drain pipe (9). In order to facilitate the manufacture of a pipe coupling with a single mould and in a single working cycle, said collecting pipe (4), said jointing pipes (3, 6) and water seal (5, 7) are designed as a single integral tubular unit, wherein the water seal comprises a straight pipe element (7), fitted with a partition (5) and extending downwards to provide a water seal compartment below the plane of said collecting pipe.

15 Claims, 1 Drawing Figure

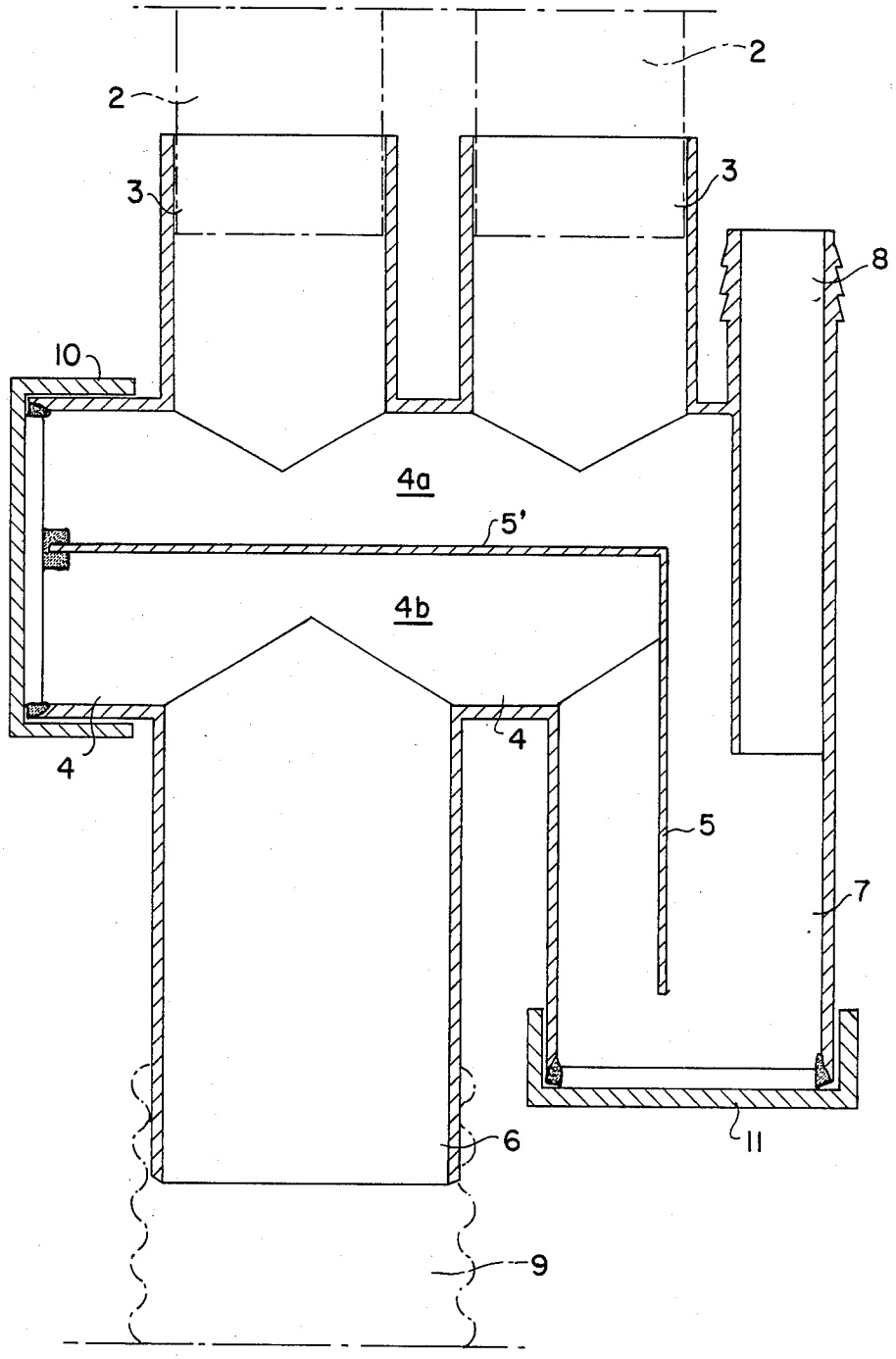
2
2
3
3
8
10
4a
5'
4b
4
4
5
7
6
11
9

PIPE COUPLING WITH WATER SEAL BETWEEN THE SINKS OF A DRAIN BOARD AND THE DRAIN PIPE

Pipe coupling with water seal between the sinks of a drain board and the drain pipe.

The present invention relates to a water seal equipped pipe coupling between the sinks of a drain board and the drain pipe, comprising a collecting pipe having connected thereto one or a plurality of jointing pipes for sink connecting tubes and a water-seal-forming pipe element, as well as a jointing pipe for said drain pipe.

This type of pipe coupling is disclosed in the Applicant's FI publication print 57998. This pipe system achieves maximum space saving in the cupboard space below the sinks, since the collecting pipe together with its water seal can be fitted adjacent to the back wall of the cupboard space.

An object of the invention is to further develop such a pipe coupling in a manner that it can be manufactured with a single mould and in a single working cycle, whereby the manufacturing costs of a pipe coupling decrease substantially and, in addition, the installation work becomes easier.

This object is achieved on the basis of the inventive features set out in the annexed claims.

The invention will now be described with reference to the accompanying drawing, showing a pipe coupling of the invention as a vertical section in the direction of the longitudinal axis of the collecting pipe.

In the present embodiment, a pipe coupling is to be connected to the drain wells of two adjacent dishwashing sinks, said wells being connected to jointing pipes 3 by means of connecting pipes (not shown) extending as close to the sink bottoms as possible, said jointing pipes being connected to a common collecting pipe 4. One end of collecting pipe 4 is fitted with a water seal in a manner that from the end of collecting pipe 4 extends downwards a straight pipe element 7 parallel to jointing pipes 3, said element being divided into two sections by a partition 5 whose upper end joins a horizontal partition 5' dividing said collecting pipe 4 into an upper flow compartment **4*a* and a lower flow compartment 4*b*. The compartment of water seal 7 on the other side of partition 5, 5' as well as compartment 4*b* of collecting pipe 4 are in direct contact with a downwardly directed jointing pipe 6 to which a drain pipe can be connected. The drain pipe may comprise e.g. a resilient corrugated plastic tube 9 for making connection between jointing pipe 6** and a fixed drain pipe without positioning problems.

The lower end of partition 5 extends in pipe 7 substantially below the lower rim of collecting pipe 4, the water remaining in pipe 7 below the lower rim of collecting pipe 4 providing a water seal. The lower end of pipe 7 is closed by a screw-thread cap 11 and the other end of collecting pipe 4 is closed by a screw-thread cap 10, sealed against the end of partition 5'. Connected to collecting pipe 4 is a washing machine's connecting tube 8, whose lower end extends in the water seal pipe 7 below the plane of the lower rim of collecting pipe 4 but above the plane of the lower edge of partition 5.

As the water seal is designed as a straight pipe element 7 provided with partition 5, said collecting pipe 4 together with its jointing pipes 3, 6 and water seal 5, 7 can be manufactured with a single mould and in a single working cycle. It is therefore preferable that the drain jointing pipe 6 and the water seal pipe element 7 extend downwards parallel and adjacent to each other and the sink jointing pipes 3 extend upwards parallel and adjacent to each other.

The sinks can be connected to jointing pipes 3 by means of telescopic connecting tubes 2 which make it possible to adjust the position of a pipe coupling in the axial direction of collecting pipe 4.

We claim:

1. A pipe coupling with a water seal between at least one sink of a drain board and a drain pipe said sink having a connecting tube, comprising a single integral one piece tubular unit having a collecting pipe portion divided in two by a partition having connected thereto at least one upper jointing pipe on one side of said partition for connection to said sink connecting tube, a pipe element portion divided in two by a partition that is continuous with said collecting pipe partition, and forming a water seal, and a lower jointing pipe portion adapted for connection to said drain pipe and lying on the opposite side of said partition from said upper jointing pipe portion.

2. A pipe coupling as set forth in claim 1, wherein said pipe element portion extends vertically downwards and said partition in said collecting pipe portion separates, in the collecting pipe portion, an upper flow compartment and a lower flow compartment, said upper jointing pipe portion being connected to the upper flow compartment and said drain jointing pipe being connected to the lower flow compartment.

3. A pipe coupling as set forth in claim 1 or 2, wherein said pipe element portion and said upper and lower jointing pipe portion are parallel to each other and are connected perpendicularly to said collecting pipe portion.

4. A pipe coupling as set forth in claim 2, wherein said lower jointing pipe portion and said pipe element portion extend vertically downwards parallel and adjacent to each other, and there is a plurality of said upper jointing pipe portion extending upwards parallel and adjacent to each other.

5. A pipe coupling as set forth in claim 1, wherein the end of said water seal forming pipe element portion is closed by a screw-thread cap.

6. A pipe coupling with a water seal between at least one sink of a drain board and a drain pipe comprising a collecting pipe having connected thereto at least one jointing pipe for a sink-connecting tube, a pipe element to form a water seal, and a jointing pipe for said drain pipe, said collecting pipe, said jointing pipe and said water seal being a single integral tubular unit, wherein the water seal comprises a straight pipe element fitted with a partition, said pipe element extending downwards and said partition extending into said collecting pipe in a manner that the partition extension separates in the collecting pipe an upper flow compartment and a lower flow compartment, said sink jointing pipe connecting to the upper flow compartment and said drain jointing pipe connecting to the lower flow compartment, and connected to said collecting pipe is a washing machine's connecting tube, whose lower end extends into the water seal forming pipe element below the plane of the lower rim of said collecting pipe but above the plane of the lower edge of said partition.

7. A pipe coupling as set forth in any of claims 1, 2 and 4, wherein said collecting pipe portion and the partition extending therethrough are both horizontal.

8. A pipe coupling as set forth in claim 5, wherein said collecting pipe and the partition extending therethrough are both horizontal.

9. A pipe coupling with a water seal between at least one sink of a drain board and a drain pipe, said sink having a connecting tube, comprising a single integral tubular unit having a collecting pipe divided in two by a partition having connected thereto at least one upper jointing pipe on one side of said partition for connection to said sink connecting tube, a pipe element divided in two by a partition that is continuous with said collecting pipe partition, and forming a water seal, and a lower jointing pipe adapted for connection to said drain pipe and lying on the opposite side of said partition from said upper jointing pipe, the end of said water seal forming pipe element being closed by a screw-thread cap, the end of said collecting pipe distant from said pipe element being closed by a screw threaded cap that is sealed against the end of the portion.

10. A pipe coupling with a water seal between two sinks of a drain pipe, comprising a collecting pipe portion having connected thereto a plurality of upper jointing pipe portions for sink connecting tubes and pipe element portion to form a water seal as well as a lower jointing pipe portion for said drain pipe, comprising a single integral one-piece tubular unit providing said collecting pipe portion, said jointing pipe portions, and said pipe element portion, wherein said pipe element portion is straight and is fitted with a partition, said pipe element portion extending downwards and its said partition extending into said collecting pipe portion in a manner that the partition extension separates in the collecting pipe portion an upper flow compartment and a lower flow compartment, said upper jointing pipe portions connecting to the upper flow compartment and said lower jointing pipe portion connecting to the lower flow compartment, the lower jointing pipe portion and said pipe element portion being located on the opposite side of said collecting pipe portion from said upper jointing pipe portions and at least partly on the same axial stretch of collecting pipe portion as the sink jointing pipe portions.

11. A pipe coupling as set forth in claim 10 wherein said pipe element portion and said jointing pipe portion are all parallel to each other and are connected perpendicularly to said collecting pipe.

12. A pipe coupling having a water seal between a sink of a drain board and a drain pipe therebelow, comprising at least one vertical upper jointing pipe connected to said sink by a connecting tube, a horizontal collecting pipe closed at one end, and connected to a lower end of said upper jointing pipe, a vertical pipe element joined to and extending down from the other end of said collecting pipe and forming a water seal therewith, and having a closed lower end, and a vertical lower jointing pipe connecting said collecting pipe to said drain pipe, each of said collecting pipe said upper and lower jointing pipes and said pipe element being a single straight tubular unit, said vertical pipe element and said collecting pipe including a continuous horizontal partition sealed against the closed end of said collection pipe, separating said upper and lower jointing pipes from each other and extending down into said pipe element short of its closed lower end, communication between said upper and lower jointing pipes being solely via said vertical pipe element at a level below said collecting pipe on one side of said partition and back up thereto on the other side of said partition.

13. The pipe coupling of claim 12 wherein there is a plurality of said upper jointing pipes, parallel to each other and at least partially on the same axial stretch as the partition lying within said collecting pipe.

14. The pipe coupling of either claim 12 or claim 13 wherein said jointing pipes, said collecting pipes, said pipe element, and said partition comprising a single molded unit, with said closed end provided by screw caps.

15. The pipe coupling of claim 12 having, connected to said collecting pipe, a washing machine's connecting tube whose lower end extends into said pipe element below the plane of the lower rim of the collecting pipe but above the plane of the lower edge of said partition.

* * * * *

UNITED STATES PATENT AND TRADEMARK OFFICE

CERTIFICATE OF CORRECTION

PATENT NO. : 4,615,053
DATED : October 7, 1986
INVENTOR(S) : Haikki Masalin et al It is certified that error appears in the above-identified patent and that said Letters Patent are hereby corrected as shown below:

Column 3, line 4, which is line 2 of claim 7,

"and 4" should read --4 and 10--.

Column 3, line 6, which is line 1 of claim 8,

"claim 5" should read --claim 6--.

Column 3, line 31, which is line 4 of claim 10,

"and pipe" should read --and a pipe--.

Signed and Sealed this

Seventeenth Day of March, 1987

*Attest:*

DONALD J. QUIGG

*Attesting Officer*

*Commissioner of Patents and Trademarks*